US010894696B2

(12) United States Patent
Guilani et al.

(10) Patent No.: US 10,894,696 B2
(45) Date of Patent: Jan. 19, 2021

(54) BELT WITH GUIDE ELEMENTS

(71) Applicant: Otis Elevator Company, Farmington, CT (US)

(72) Inventors: Brad Guilani, Woodstock Valley, CT (US); Richard N. Fargo, Plainville, CT (US); Daniel A. Mosher, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 327 days.

(21) Appl. No.: 15/206,947

(22) Filed: Jul. 11, 2016

(65) Prior Publication Data

US 2018/0009634 A1 Jan. 11, 2018

(51) Int. Cl.

| | |
|---|---|
| ***B66B 15/04*** | (2006.01) |
| ***B66B 7/06*** | (2006.01) |
| ***B66B 9/00*** | (2006.01) |

(52) U.S. Cl.

CPC ..... *B66B 7/062* (2013.01); *B66B 9/00* (2013.01); *B66B 15/04* (2013.01)

(58) Field of Classification Search

CPC ... B66B 11/009; B66B 11/08; B66B 11/0085; B66B 11/008; B66B 15/04

See application file for complete search history.

(56) References Cited

U.S. PATENT DOCUMENTS

| | | | | |
|---|---|---|---|---|
| 4,756,388 | A | 7/1988 | Heikkinen | |
| 6,371,448 | B1 | 4/2002 | De Angelis | |
| 6,419,208 | B1 | 7/2002 | Baranda et al. | |
| 7,040,456 | B2 | 5/2006 | Ach et al. | |
| 7,971,687 | B2 | 7/2011 | Alves et al. | |
| 8,336,675 | B2 * | 12/2012 | Ach | B66B 7/062 187/251 |
| 8,348,019 | B2 | 1/2013 | Blochle et al. | |
| 2003/0051948 | A1 * | 3/2003 | Drabot | B66B 9/027 187/254 |
| 2003/0121729 | A1 | 7/2003 | Heinz et al. | |
| 2007/0062762 | A1 | 3/2007 | Ach | |

(Continued)

FOREIGN PATENT DOCUMENTS

| | | | |
|---|---|---|---|
| AU | 2007205741 | A1 | 2/2008 |
| CN | 104192675 | A | 12/2014 |

(Continued)

OTHER PUBLICATIONS

European Search Report Issued in EP Application No. 17180832.2, dated Jan. 12, 2018, 11 Pages.

(Continued)

*Primary Examiner* — Diem M Tran

(74) *Attorney, Agent, or Firm* — Cantor Colburn LLP

(57) ABSTRACT

A belt for an elevator system including a plurality of tension members arranged along a belt width and a jacket material at least partially encapsulating the plurality of tension members defining a traction surface interactive with a traction sheave of an elevator system and a back surface opposite the traction surface. The back surface includes a belt guide feature extending along a belt length and interactive with a complimentary guide sheave feature of a guide sheave of the elevator system to orient the belt to a selected location during operation of the elevator system.

13 Claims, 6 Drawing Sheets

(56) References Cited

U.S. PATENT DOCUMENTS

| | | | | |
|---|---|---|---|---|
| 2009/0166132 | A1 | 7/2009 | Ach | |
| 2010/0133046 | A1* | 6/2010 | Allwardt | B66B 7/08 187/251 |
| 2011/0088981 | A1* | 4/2011 | Urbani | B66B 7/062 187/251 |
| 2014/0246275 | A1 | 9/2014 | Korvenranta et al. | |
| 2016/0016759 | A1 | 1/2016 | Jarmo et al. | |

FOREIGN PATENT DOCUMENTS

| | | | |
|---|---|---|---|
| DE | 202008001786 | U1 | 12/2008 |
| DE | 102009025954 | A1 | 12/2010 |
| EP | 1396458 | A2 | 3/2004 |
| EP | 1446350 | B1 | 2/2006 |
| EP | 1886959 | A1 | 2/2008 |
| WO | 0134510 | A1 | 5/2001 |
| WO | 2006042427 | A1 | 4/2006 |
| WO | 2014147291 | A1 | 9/2014 |
| WO | WO2015076822 | A1 | 5/2015 |
| WO | 2015152899 | A1 | 10/2015 |

OTHER PUBLICATIONS

European Office Action for European Application No. 17180832.2, dated Aug. 24, 2020, 4 pages.
Chinese Office Action for Chinese Application No. 201710558901.6, dated May 6, 2020, 8 pages.

* cited by examiner

FIG .2
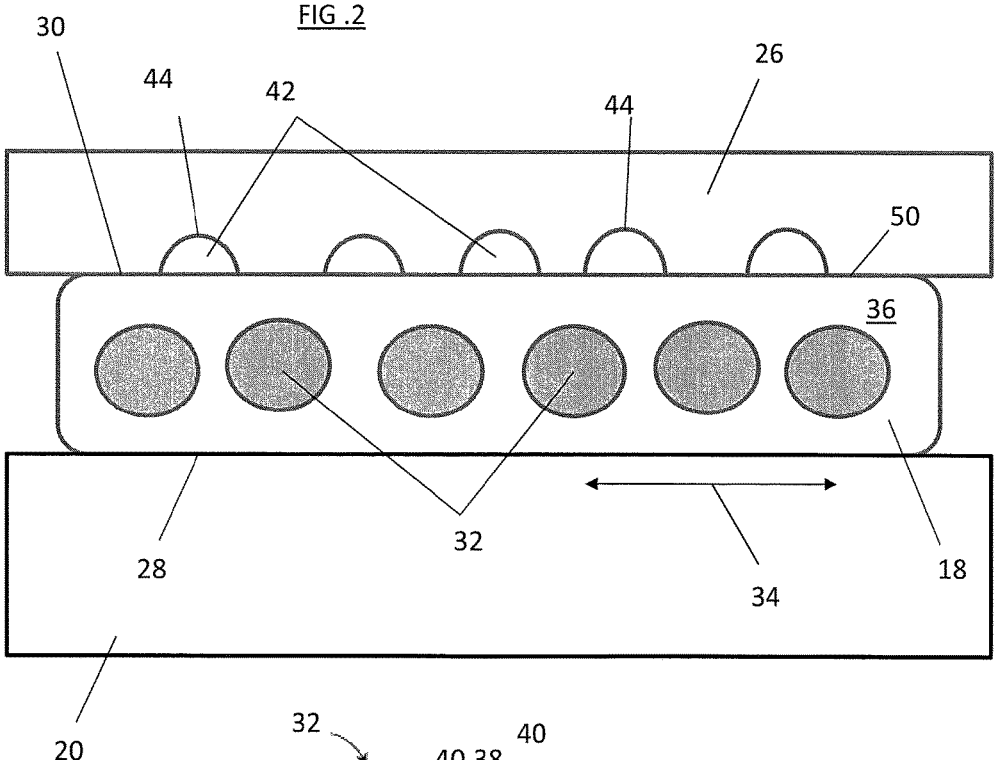
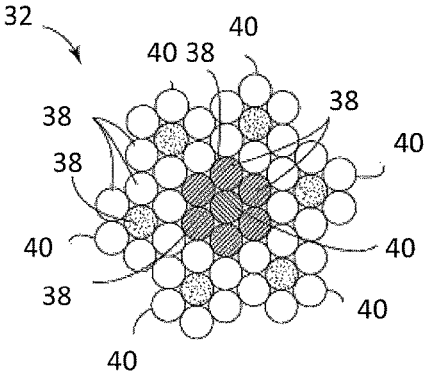
FIG. 3

BELT WITH GUIDE ELEMENTS

BACKGROUND

Embodiments disclosed herein relate to elevator systems, and more particularly, to shape of a load bearing member for use in an elevator system and guidance of the load bearing member.

Elevator systems are useful for carrying passengers, cargo, or both, between various levels in a building. Some elevators are traction based and utilize load bearing members such as belts for supporting the elevator car and achieving the desired movement and positioning of the elevator car.

Where belts are used as a load bearing member, a plurality of tension elements are embedded in a common elastomer belt body. In an exemplary traction elevator system, a machine drives a traction sheave with which the belts, interact to drive the elevator car along a hoistway. Belts typically utilize tension members formed from steel elements, but alternatively may utilize tension members formed from other materials such as carbon fiber composites. Belts have been used in combination with a crowned traction sheave in many different system layouts and installations worldwide. The use of the crowned traction sheave ensures centering of the belt within the width of each groove of the traction sheave. However, the use of a crown on the traction sheave has several drawbacks such as uneven pressure distribution on the jacket as well as uneven load sharing by the cords inside the belt.

BRIEF SUMMARY

In one embodiment, a belt for an elevator system including a plurality of tension members arranged along a belt width and a jacket material at least partially encapsulating the plurality of tension members defining a traction surface interactive with a traction sheave of an elevator system and a back surface opposite the traction surface. The back surface includes a belt guide feature extending along a belt length and interactive with a complimentary guide sheave feature of a guide sheave of the elevator system to orient the belt to a selected location during operation of the elevator system.

Additionally or alternatively, in this or other embodiments the belt guide feature is convex feature protruding from the back surface.

Additionally or alternatively, in this or other embodiments a plurality of belt guide features are arrayed across a width of the belt.

Additionally or alternatively, in this or other embodiments the belt guide feature has one of a curvilinear or V-shaped cross-section.

Additionally or alternatively, in this or other embodiments the belt guide feature is discontinuous along the belt length.

Additionally or alternatively, in this or other embodiments the belt guide feature includes a plurality of belt guide feature segments separated along the belt length by a plurality of feature gaps.

Additionally or alternatively, in this or other embodiments the belt guide feature has a lower durometer than the traction surface.

In another embodiment, an elevator system includes a hoistway, an elevator car located in the hoistway and movable along the hoistway, a traction sheave with flat traction surfaces and a belt operably connected to the traction sheave and the elevator car to move the elevator car along the hoistway. The belt includes a plurality of tension members arranged along a belt width and a jacket material at least partially encapsulating the plurality of tension members defining a traction surface interactive with the flat traction sheave and a back surface opposite the traction surface. The back surface includes a belt guide feature extending along a belt length and interactive with a complimentary guide sheave feature of a guide sheave of the elevator system to orient the belt to a selected location during operation of the elevator system.

Additionally or alternatively, in this or other embodiments the belt guide feature is convex feature protruding from the back surface.

Additionally or alternatively, in this or other embodiments a plurality of belt guide features are arrayed across a width of the belt.

Additionally or alternatively, in this or other embodiments the belt guide feature has one of a curvilinear or V-shaped cross-section.

Additionally or alternatively, in this or other embodiments the belt guide feature is discontinuous along the belt length.

Additionally or alternatively, in this or other embodiments the belt guide feature includes a plurality of belt guide feature segments separated along the belt length by a plurality of feature gaps.

Additionally or alternatively, in this or other embodiments a biasing member is operably connected to the guide sheave to bias the guide sheave toward the belt.

Additionally or alternatively, in this or other embodiments a distance between the guide sheave and the traction sheave is in the range of 0.2 times and 2.0 times a traction sheave diameter.

Additionally or alternatively, in this or other embodiments a plurality of belts are arranged along a width of the flat traction sheave.

Additionally or alternatively, in this or other embodiments the belt guide feature has a lower durometer than the traction surface.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

FIG. 2 is a cross-sectional view of an embodiment of a belt for an elevator system;

FIG. 3 is a cross-sectional view of an embodiment of a tension member for an elevator system;

The detailed description explains disclosed embodiments, together with advantages and features, by way of example with reference to the drawings.

DETAILED DESCRIPTION

Figure 1:
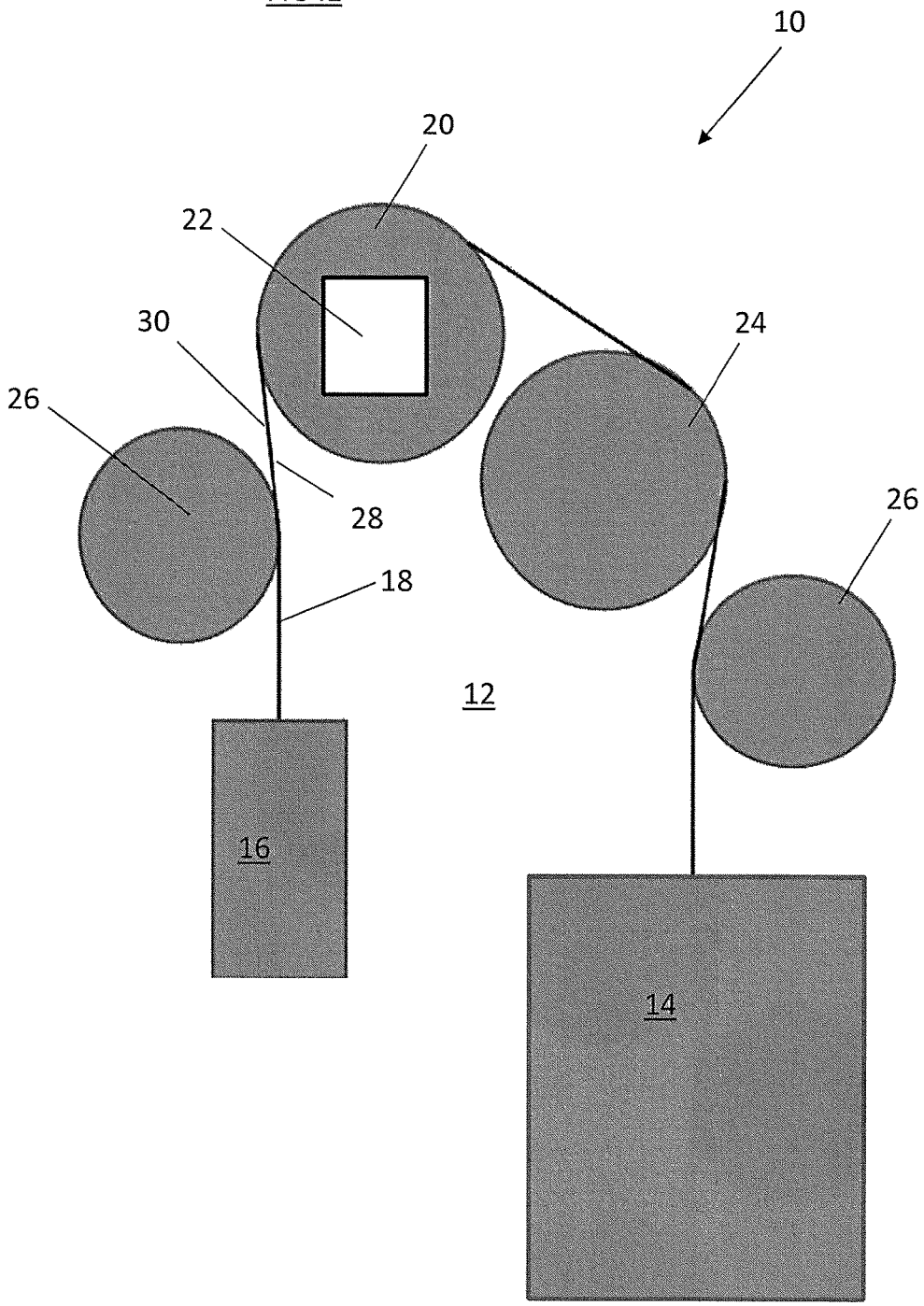
FIG. 1 is a perspective view of an example of a traction elevator system.

Referring now to FIG. 1, an exemplary embodiment of an elevator system 10 is illustrated. The elevator system 10 includes an elevator car 14 configured to move vertically upwardly and downwardly within a hoistway 12 along a plurality of car guide rails (not shown). Guide assemblies mounted to the top and bottom of the elevator car 14 are configured to engage the car guide rails to maintain proper alignment of the elevator car 14 as it moves within the hoistway 12.

The elevator system 10 also includes a counterweight 16 configured to move vertically upwardly and downwardly within the hoistway 12. The counterweight 16 moves in a direction generally opposite the movement of the elevator car 14 as is known in conventional elevator systems. Movement of the counterweight 16 is guided by counterweight guide rails (not shown) mounted within the hoistway 12. In the illustrated, non-limiting embodiment, at least one load bearing member, for example, a belt 18, coupled to both the elevator car 14 and the counterweight 16 cooperates with a traction sheave 20 mounted to a drive machine 22. To cooperate with the traction sheave 20, at least one belt 18 bends in a first direction about the traction sheave 20. Although the elevator system 10 illustrated and described herein has a 1:1 roping configuration, elevator systems 10 having other roping configurations such as 2:1 and hoistway layouts are within the scope of the present disclosure. The at least one belt 18 may also be routed over one or more other sheaves, for example, a deflector sheave 24 located between the traction sheave 20 and the elevator car 14. While not shown in the embodiment of FIG. 1, additional deflector sheaves 24 may be utilized in the elevator system 10 to direct the at least one belt 18 to selected positions in the hoistway 12. For example, additional deflector sheaves 24 may be located between the traction sheave 20 and the elevator car 14 and/or between the traction sheave 20 and the counterweight 16.

The elevator system 10 further includes one or more guide sheaves 26 configured to guide the belt 18, such that the belt 18 is positioned in a desired location along the deflector sheave 24 and/or the traction sheave 20. To prevent excessive wear of the belt 18 or to prevent inadvertent slippage of the belt 18, the desired location is at or about a lateral center of the traction sheave 20, as shown in FIG. 2. Referring again to FIG. 1, the belt 18 includes a traction surface 28 interactive with the traction sheave 20 to drive the elevator car 14 and/or the counterweight 16 of the elevator system 10. The traction surface 28 may additionally be interactive with the deflector sheaves 24. The belt 18 further includes a back surface 30 opposite the traction surface 28. The back surface 30 is interactive with the guide sheaves 26 to guide positioning of the belt 18 relative to the traction sheave 20 and/or the deflector sheave 24.

Referring again to FIG. 2, the belt 18 includes plurality of tension members 32 extending along the belt 18 length and arranged across a belt width 34. In some embodiments, the tension members 32 are equally spaced across the belt width 34. The tension members 32 are at least partially enclosed in a jacket material 36 to restrain movement of the tension members 32 in the belt 18 and to protect the tension members 32. The jacket material 36 defines the traction surface 28 configured to contact a corresponding surface of the traction sheave 20. Exemplary materials for the jacket material 36 include the elastomers of thermoplastic and thermosetting polyurethanes, polyamide, thermoplastic polyester elastomers, and rubber, for example. Other materials may be used to form the jacket material 36 if they are adequate to meet the required functions of the belt 18. For example, a primary function of the jacket material 36 is to provide a sufficient coefficient of friction between the belt 18 and the traction sheave 20 to produce a desired amount of traction therebetween. The jacket material 36 should also transmit the traction loads to the tension members 32. In addition, the jacket material 36 should be wear resistant and protect the tension members 32 from impact damage, exposure to environmental factors, such as chemicals, for example.

Figure 4:
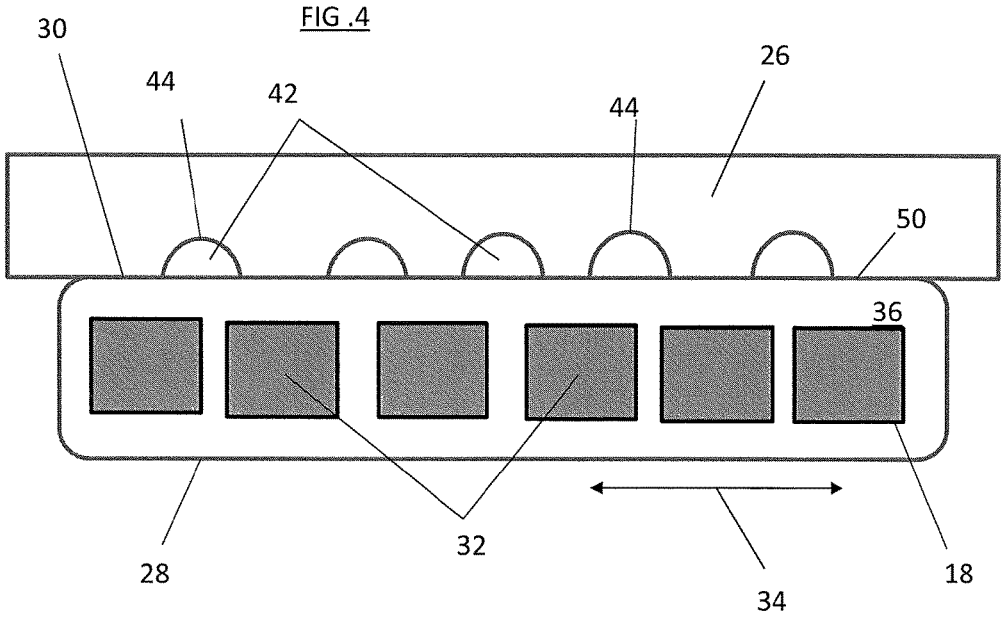
FIG. 4 is a cross-sectional view of another embodiment of a belt for an elevator system.

In some embodiments, as shown in FIGS. 2 and 3, each tension member 32 is formed from a plurality of metallic, for example steel, wires 38, arranged into a plurality of strands 40, which are in turn arranged into a cord, or tension member 32. In other embodiments, the tension members 32 may be formed from other materials and may have other configurations. For example, in some embodiments, such as shown in FIG. 4, the tension member 32 may be formed from a plurality of fibers arranged in a rigid matrix composite. While in the embodiment shown there are six tension members 32 in the belt 18, the number of tension members 32 is merely exemplary. In other embodiments, for example, one, two, three, four, five, six or more tension members 32 may be utilized. It is to be appreciated that arrangement of wires 38 shown in FIG. 3 is merely exemplary, and that other arrangements of wires 38 to form tension members 32 are contemplated within the scope of the present disclosure.

Referring again to FIG. 2, the guidance of the belt 18 to the deflector sheave 24 and/or the traction sheave 20 is provided by one or more belt guide features 42 at the back surface 30 of the belt 18 that are configured to mesh with complimentary guide sheave features 44 of the guide sheave 26. In some embodiments, such as shown in FIG. 2, the belt guide features 42 each include a convex arc extending outwardly from the back surface 30, while the guide sheave features include a concave arc located at a guide sheave surface 50. In other embodiments, the configuration may be reversed, with the guide sheave features 44 including the convex arc and the belt guide features 42 including the concave arc. In some embodiments, multiple guide features may be utilized across the belt width 34 as shown in FIG. 2, while in other embodiments, a single belt guide feature 42 and complimentary guide sheave feature 44 may be used to guide the belt 18.

Figure 5:
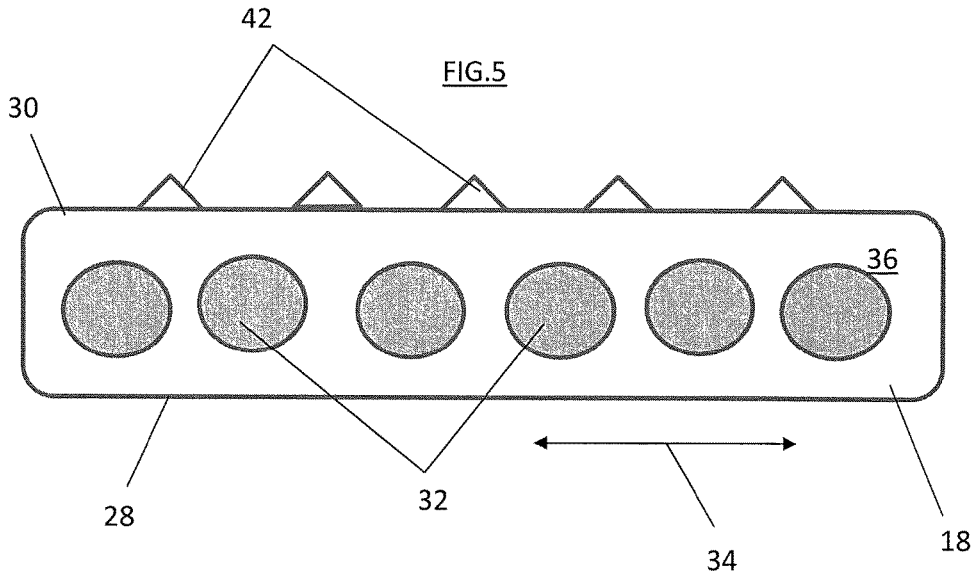
FIG. 5 is a cross-sectional view of another embodiment of a belt for an elevator system.
Figure 6:
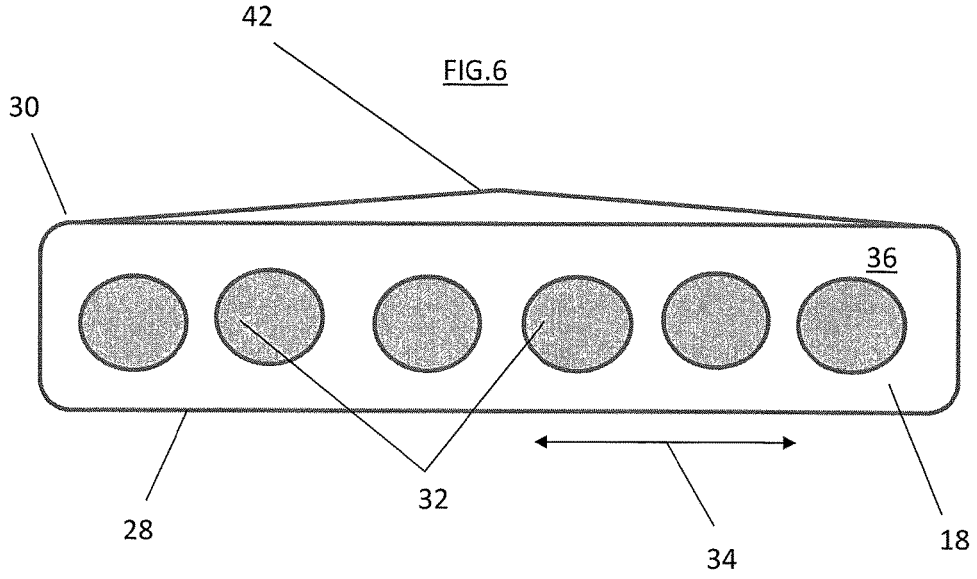
FIG. 6 is a cross-sectional view of yet another embodiment of a belt for an elevator system.

Referring now to FIG. 5, in other embodiments, the belt guide features 42 and complimentary guide sheave features 44 may have other shapes, such as a "V"-shape or taper as shown. Further, a single belt guide feature 42 and complimentary guide sheave feature 44 may be utilized, as shown in FIG. 6. In the embodiment of FIG. 6, the "V"-shape is continuous over the entire belt width 34, but in other embodiments, the "V"-shape may extend partially across the belt width 34. The shapes and configurations of belt guide features 42 and complimentary guide sheave features 44 disclosed herein are merely exemplary, and one skilled in the art will recognize that other shapes and configurations of such features may be utilized.

Figure 7:
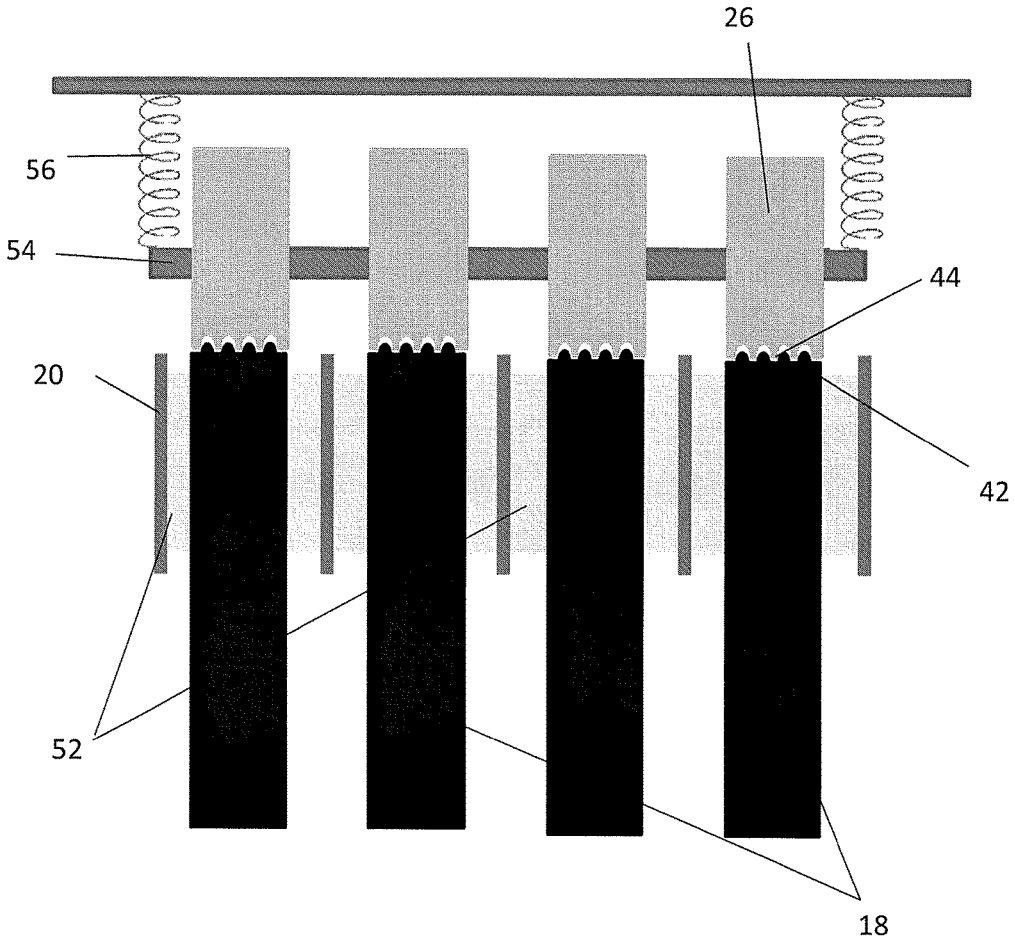
FIG. 7 is an illustration of a traction sheave and guide sheave arrangement for an elevator system.

Referring now to FIG. 7, illustrated is a traction sheave 20 and guide sheave 26 arrangement for an elevator system 10 having multiple belts 18. The traction sheave 20 includes a sheave location or groove 52 for each belt 18 of the elevator system 10. The guide sheave 26 includes multiple arrangements of guide sheave features 44, one set of guide sheave features 44 for each belt 18, which interact with the belt guide features 42 of each belt 18. The guide sheave surface 50 may be continuous across the multiple belt width, or as shown in FIG. 7, may comprise multiple guide sheave surfaces 50 supported by an axle 54. Further, as shown, in some embodiments, a biasing member 56 such as a spring may be utilized to bias a position of the guide sheave toward the belt 18, urging the guide sheave features 44 into interactive contact with the belt guide features 42 of the belt 18.

Figure 8:
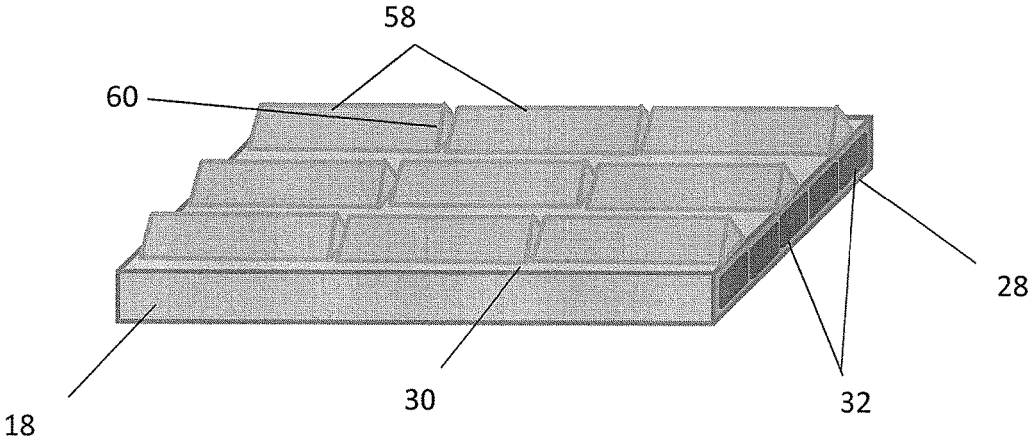
FIG. 8 is an illustration of an elevator belt with discontinuous guide features.
Figure 9:
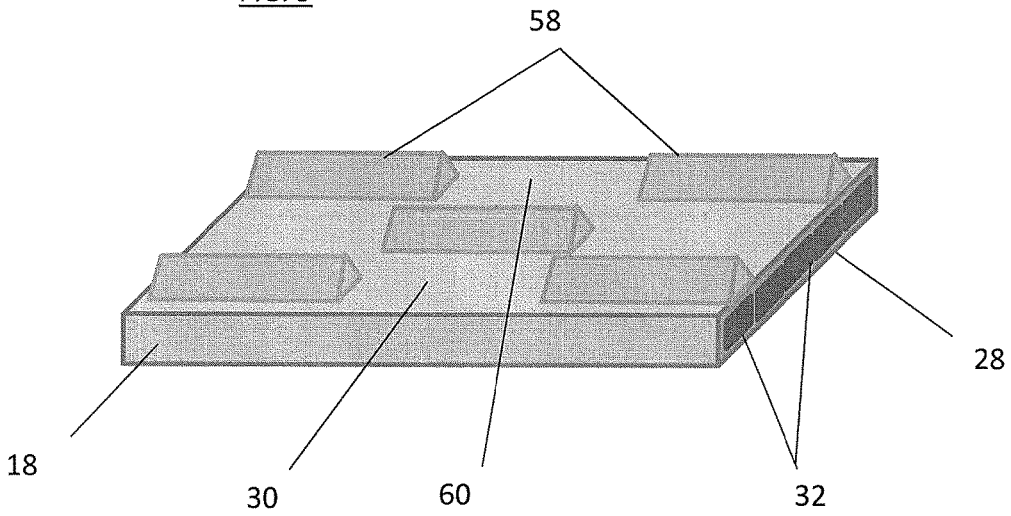
FIG. 9 is an illustration of another elevator belt with discontinuous guide features.

One concern with the addition of belt guide features 42 to the back surface 30 is a potential increase in stiffness of the belt 18, limiting the ability of the belt 18 to conform to the shape of the traction sheave 20 and/or the deflector sheave 24. In some embodiments, to reduce the stiffness of the belt 18, a height of the belt guide features 42 is below about 3 mm. In some embodiments, the belt guide features 42 may be discontinuous along the belt 18 length. For example, as shown in FIG. 8, the belt guide features 42 may comprise a plurality of feature segments 58 extending along the belt 18 length. The feature segments 58 are separated by a feature gap 60, which results in a reduction of belt 18 stiffness compared to a belt 18 with continuous belt guide features 42. In other embodiments, such as shown in FIG. 9, the belt guide features 42 may be formed continuous along the belt 18 length, then segmented into feature segments 58 by a cutter or other tool, allowing the belt 18 to more readily conform to the traction sheave 20 and/or the deflector sheave 24. The Further, the guide features 42 may be formed from a material different from the jacket material 36 with a selected hardness so the effect of the guide features 42 on bending stiffness of the belt 18 is minimized. For example, in some embodiments the guide features 42 may be formed having a durometer hardness of between 60 and 80 on the Shore A hardness scale, while the traction surface 28 has a durometer hardness of over 80. The guide features 42 may be co-extruded with the jacket material 36 to form the belt 18 or alternatively may be formed separately and bonded to the jacket material 36 after the jacket material 36 is formed over the tension members 32.

A distance between the guide sheave 26 and the associated deflector sheave 24 or traction sheave 20 determines a "force" necessary to steer the belt 18 to the desired position at the deflector sheave 24 or traction sheave 20. The larger the distance, the smaller the force required. On the other hand the guide sheave 26 must be close enough to the associated deflector sheave 24 or traction sheave 20 to control the belt 18 position and effectively guide the belt 18. In some embodiments a distance between the guide sheave 26 and the associated deflector sheave 24 or traction sheave 20 is between about 0.2 and 2.0 times a deflector sheave 24 diameter or traction sheave 20 diameter.

Incorporating belt guide features 42 at the back surface 30 of the belt 18 allows for the removal of guide features such as crowns or the like from the traction sheave reducing the stress gradient across the belt width at the traction sheave thereby reducing wear of portions of the belt. Further, flanges typically utilized at the traction sheave to contain the belt at the traction sheave may be reduced or removed. Further still, since the belt guide features 42 and the guide sheave 26 align the belt 18 before encountering the traction sheave 20, a width of the traction sheave 20 may be reduced.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A belt for an elevator system comprising:

a plurality of tension members arranged along a belt width; and a jacket material at least partially encapsulating the plurality of tension members defining:

a traction surface interactive with a traction sheave of an elevator system;

and a back surface opposite the traction surface, the back surface including a plurality of belt guide features arrayed across a width of the belt and extending along a belt length and interactive with a complimentary guide sheave feature of a guide sheave of the elevator system to orient the belt to a selected location during operation of the elevator system, the plurality of belt guide features disposed along the belt width between adjacent tension members of the plurality of tension members, wherein at least one belt guide feature of the plurality of belt guide features is a convex arc feature protruding outwardly from the back surface;

wherein the traction surface is flat.

2. The belt of claim 1, wherein at least one belt guide feature of the plurality of belt guide features has one of a curvilinear or V-shaped cross-section.

3. The belt of claim 1, wherein the plurality of belt guide features are discontinuous along the belt length.

4. The belt of claim 3, wherein the plurality of belt guide features includes a plurality of belt guide feature segments separated along the belt length by a plurality of feature gaps.

5. The belt of claim 1, wherein a belt guide feature of the plurality of belt guide features has a lower durometer than the traction surface.

6. An elevator system comprising:

a hoistway;

an elevator car disposed in the hoistway and movable along the hoistway;

a traction sheave with flat traction surfaces; and a belt operably connected to the traction sheave and the elevator car to move the elevator car along the hoistway, the belt including:

a plurality of tension members arranged along a belt width; and a jacket material at least partially encapsulating the plurality of tension members defining:

a traction surface interactive with the flat traction sheave; and a back surface opposite the traction surface, the back surface including a plurality of belt guide features arrayed across a belt width and extending along a belt length and interactive with a complimentary guide sheave feature of a guide sheave of the elevator system to orient the belt to a selected location during operation of the elevator system, the plurality of belt guide features disposed along the belt width between adjacent tension members of the plurality of tension members, wherein the at least one belt guide feature of the plurality of belt guide features is a convex arc feature protruding outwardly from the back surface;

wherein the traction surface is flat.

7. The elevator system of claim 6, wherein the at least one belt guide feature has one of a curvilinear or V-shaped cross-section.

8. The elevator system of claim 6, wherein the plurality of belt guide features are discontinuous along the belt length.

9. The elevator system of claim 8, wherein the plurality of belt guide features include a plurality of belt guide feature segments separated along the belt length by a plurality of feature gaps.

10. The elevator system of claim 6, further comprising a biasing member operably connected to the guide sheave to bias the guide sheave toward the belt.

11. The elevator system of claim 6, further comprising a plurality of belts arranged along a width of the flat traction sheave.

12. The elevator system of claim 6, wherein the belt guide feature has a lower durometer than the traction surface.

13. An elevator system comprising:

a hoistway;

an elevator car disposed in the hoistway and movable along the hoistway;

a traction sheave with flat traction surfaces; and a belt operably connected to the traction sheave and the elevator car to move the elevator car along the hoistway, the belt including:

a plurality of tension members arranged along a belt width; and a jacket material at least partially encapsulating the plurality of tension members defining:

a traction surface interactive with the flat traction sheave; and a back surface opposite the traction surface, the back surface including a belt guide feature extending along a belt length and interactive with a complimentary guide sheave feature of a guide sheave of the elevator system to orient the belt to a selected location during operation of the elevator system wherein a distance between the guide sheave and the traction sheave is in the range of 0.2 times and 2.0 times a traction sheave diameter;

wherein the traction surface is flat.

* * * * *